US006962063B1

(12) United States Patent
Pearl

(10) Patent No.: US 6,962,063 B1
(45) Date of Patent: Nov. 8, 2005

(54) UNIFORMLY STRINGED MAGNETIC AND NON-MAGNETIC BEADS OF A NECKLACE AND BRACELET

(76) Inventor: Irwin Pearl, 4 Ward Dr., Yorktown Heights, NY (US) 10598

( * ) Notice: Subject to any disclaimer, the term of this patent is extended or adjusted under 35 U.S.C. 154(b) by 76 days.

(21) Appl. No.: 10/692,205

(22) Filed: Oct. 24, 2003

(51) Int. Cl.[7] ..... A44C 5/00
(52) U.S. Cl. ..... 63/3.2; 63/3; 63/3.1; 63/38
(58) Field of Search ..... 63/3, 3.1, 3.2, 63/433, 38–41; 600/15

(56) References Cited

U.S. PATENT DOCUMENTS

| | | | | |
|---|---|---|---|---|
| 4,095,587 | A * | 6/1978 | Ishikawa | 600/15 |
| D254,126 | S * | 2/1980 | Beniya | D11/6 |
| 5,137,507 | A * | 8/1992 | Park | 600/13 |
| 5,195,335 | A | 3/1993 | Hart | |
| 5,535,603 | A * | 7/1996 | Hayakawa | 63/3 |
| 6,544,164 | B1 * | 4/2003 | Fan | 600/15 |
| 2004/0092788 | A1 * | 5/2004 | Kaufman et al. | 600/15 |
| 2004/0111005 | A1 * | 6/2004 | Lu | 600/15 |
| 2004/0126621 | A1 * | 7/2004 | Fukuda | 600/15 |

FOREIGN PATENT DOCUMENTS

WO WO 93/06887 * 4/1993

* cited by examiner

*Primary Examiner*—Robert J. Sandy
*Assistant Examiner*—Ruth C. Rodriguez
(74) *Attorney, Agent, or Firm*—Myron Amer P.C.

(57) ABSTRACT

An arrangement of stringed magnetic and non-magnetic beads worn as a necklace or bracelet in loops about the user resulting from contact together of the magnetic beads and the size of the loops determined by the number of non-magnetic beads therebetween, in which the stringing is according to facilitated counting of a uniform ratio of the non-magnetic to the magnetic beads rather than tedious counting of individual beads.

2 Claims, 2 Drawing Sheets

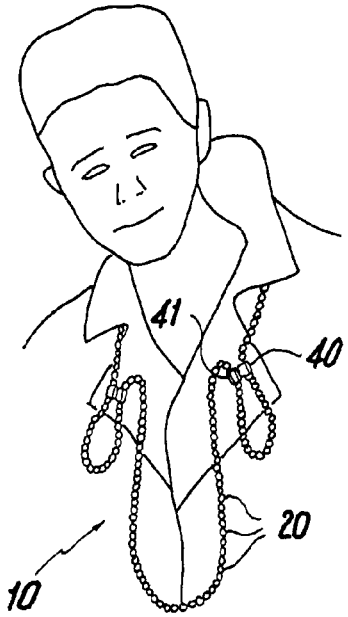
FIG. 1
(Prior Art)
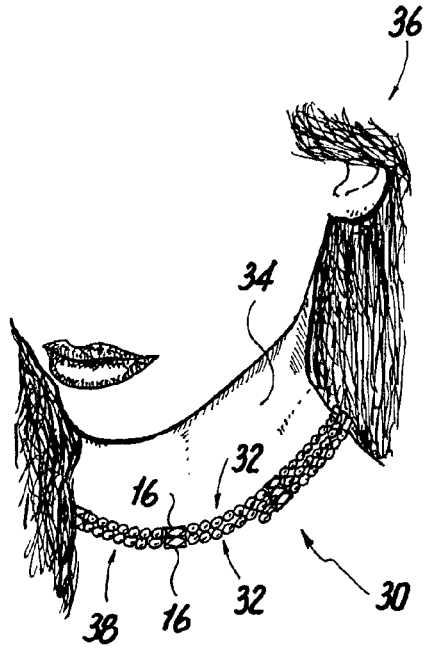
FIG. 3
FIG. 4
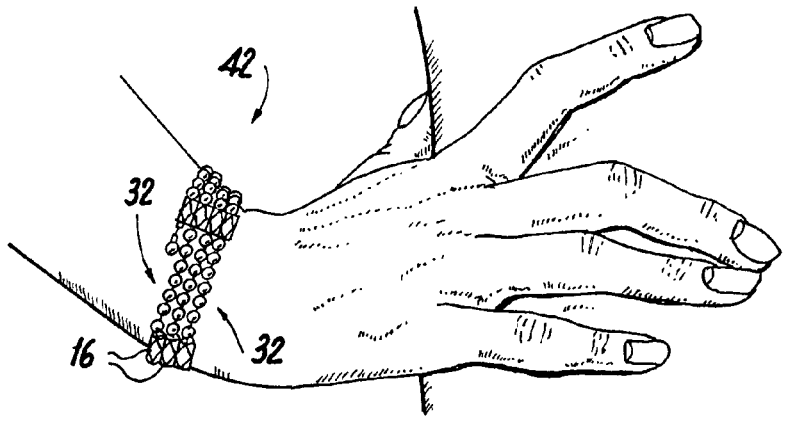

UNIFORMLY STRINGED MAGNETIC AND NON-MAGNETIC BEADS OF A NECKLACE AND BRACELET

The present invention relates generally to improvements in beaded jewelry in which, more particularly, the improvements use to greater advantage magnetic beads in their assembly into articles of manufacture.

EXAMPLE OF THE PRIOR ART

The use of magnetic beads is already well known from patent U.S. Pat. No. 5,195,335 for "Magnetic Novelty Beads" issued to James L. Hart on Mar. 23, 1993, in which magnetic beads are placed in designated positions during the stringing assembly of the beads, so that upon established contact during wear, different sizes of loops of non-magnetic beads are assumed between the sites of magnetic bead contact, to thusly constitute the appearance of the assembly, whether worn as a necklace, bracelet or the like. To achieve this desirable variation in appearance, however, the stringing or assembly is tedious since it entails that from one strategically positioned magnetic bead the next sequentially added non-magnetic beads must be counted before the addition of the next encountered magnetic bead, and this counting, as noted, adds to the tedium in producing the jewelry article of manufacture.

Broadly, it is an object of the present invention to overcome the foregoing and other shortcomings of the present invention.

More particularly, it is an object to string the two categories of beads, i.e., non-magnetic and magnetic, in a selected uniform ratio, such as for example 7 to 1 of non-magnetic to magnet, which significantly simplifies completing a significant length of stringed beads, and which has the attendant benefit of being cut to an appropriate longer length for a necklace or a shorter length for a bracelet for example, in which the repeats of the ratio are counted to determine the length, rather than being determined by tedious individual bead counting, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a tedious-assembled perspective view of a prior art necklace using magnetic beads;

FIG. 3 is a perspective view showing use of the beads of FIG. 2 worn as a necklace; and FIG. 4 is a perspective view showing use of the beads of FIG. 2 worn as a bracelet.

Figure 2:
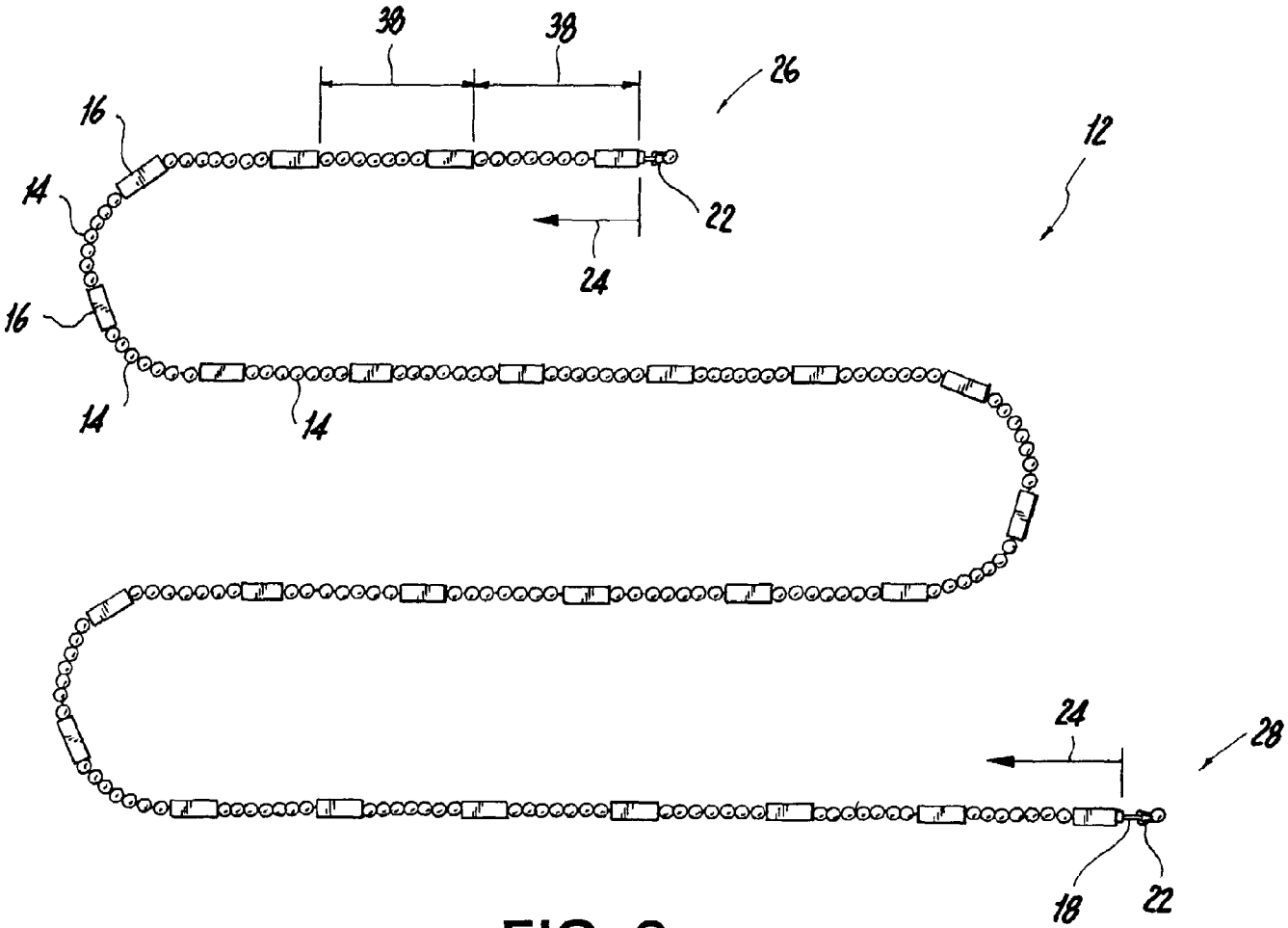
FIG. 2 is a plan view also of the use of magnetic beads but stringed according to the present invention to obviate tedium in assembly.

FIG. 1 illustrates a prior art necklace 10 having non-magnetic stringed beads 20 in a large central loop configuration and two side smaller loops that result from magnetic attraction of magnetic beads 40 and 41. To achieve this configuration, starting with magnetic bead 40 and in a clockwise direction to magnetic bead 41 requires tedious counting of the non-magnetic beads 20 therebetween, and similar even more tedious counting from magnetic bead 41 to the next encountered magnetic bead which completes the large central loop configuration. Other configurations entail the same tedious counting of non-magnetic beads 20 between initial and subsequently encountered magnetic beads 40 and 41.

Obviating the tedium in assembly is the jewelry article of manufacture of the present invention illustrated in FIGS. 2, 3 and 4, generally designated 12. Linear in nature, the article 10 is comprised of plural smaller circular non-magnetic beads 14 and a lesser number of larger oblong shaped magnetic beads 16, both having central throughbores through which plastic cord or similar appropriate construction core material 18 is projected and, as shown in FIG. 2 tied at 22, to hold the beads 14, 16 confined within the knots 22. The length of the core string 18 delimits the linear extent of the article 10, but it is to be understood that the length of the article 10 of FIG. 2 is obtained from a much greater length put up on a supply roll (not shown), unwound therefrom, and cut to the selected length 24 shown in FIG. 2, which, measured from end 26 to end 28, is approximately 36 inches. This length 24 is selected as a length appropriate for use worn on the person as a necklace 30 as shown in FIG. 3, in which it is disposed in helical turns 32 about the neck 34 of the user 36. It is important to note that the tedium of counting the non-magnetic beads 14 between magnetic beads 16 is dispensed with and instead, in accordance with the present invention, the assembly of the beads 14, 16 constituting the article 10 is according to the number of a uniform repetitive ratio of non-magnetic to magnetic beads, denoted at 38, which in FIG. 2, from one end to the other, are, by count, twenty-five repeats.

If fashion so dictates, the number of repeats could be only fifteen or twenty of the uniform ratio 38 appropriate for the helical turns 32 to be worn as a necklace 30. To the same point, a lesser number of repeats could be deemed appropriate for the helical turns 32 to be worn as a bracelet 42, as shown in FIG. 4. In both cases, and in other configurations expressing prevailing fashion in adornments of beads worn on the person, the assembly of the stringed article is significantly facilitated by the uniform repetitive ratio 38, which in a preferred embodiment is seven non-magnetic beads to one magnetic bead, but which could be otherwise as dictated mainly by the sales price of the article, and in the use of the article the wearing thereof is significantly facilitated by the magnetic attraction of a bead 16 with a counterpart to hold together the helical turns of the configurated article, and lastly there is the dispensing of male and female connectors at opposite ends of the string that have to interconnect with each other.

While the jewelry article of manufacture herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A linear jewelry article of manufacture of a selected length to be worn in encircling relation about a user's neck as a necklace and about a user's wrist as a bracelet, said article comprising:

A. a flaccid string of a selected length delimiting a linear extent thereof;

B. plural beads with central openings therethrough characterized by (1) a first select number thereof of non-magnetic construction material, and (2) a remaining second select number thereof of magnetic construction material;

C. operative positions of said plural beads disposed along said string with a bead of said first and a bead of said second select numbers in a uniform repetitive ratio to each other;

D. cutting to a selected length said stringed beads according to a number of said uniform repetitive ratios of said first and second beads occurring therealong to obviate the tedium of counting;

E. selecting as a length for cutting a length appropriate for use as a necklace and a length appropriate for use as a bracelet; and F. an operative position of a beaded string worn in helical turns on the person;

whereby when worn as a necklace and when worn as a bracelet magnetic attraction of contacting magnetic beads solely maintain said helical turns without interconnection of the opposite ends of said article.

2. A linear jewelry article of manufacture as claimed in claim 1 wherein said ratio of non-magnetic to magnetic beads is 7 to 1.

* * * * *